United States Patent [19]

Mancini

[11] Patent Number: 4,809,852

[45] Date of Patent: Mar. 7, 1989

[54] DISPOSABLE CONTAINER

[75] Inventor: Derek Mancini, Uxbridge, Canada

[73] Assignee: Inoform Equipment Ltd., Scarborough, Canada

[21] Appl. No.: 98,863

[22] Filed: Sep. 21, 1987

Related U.S. Application Data

[63] Continuation-in-part of Ser. No. 886,726, Jul. 18, 1986, Pat. No. 4,704,844.

[51] Int. Cl.[4] ..... B65D 6/02; B65D 17/24

[52] U.S. Cl. ..... 206/620; 215/32

[58] Field of Search ..... 53/453, 559; 206/610, 206/620, 822, 470; 220/4 B, 4 E, DIG. 12, DIG. 13; 215/1 C, 32

[56] References Cited

U.S. PATENT DOCUMENTS

| | | | |
|---|---|---|---|
| 3,245,197 | 4/1966 | Vanmil, Jr. et al. | 53/453 |
| 3,423,902 | 1/1969 | Stroop | 53/559 X |
| 3,521,805 | 7/1970 | Ward | 206/620 X |
| 3,640,381 | 2/1972 | Kanada et al. | 206/620 X |
| 3,721,360 | 3/1973 | Collie | 215/32 |
| 4,301,926 | 11/1981 | Chung | 206/620 |
| 4,375,146 | 3/1983 | Chung | 53/559 X |
| 4,588,090 | 5/1986 | Spuck et al. | 53/559 X |

*Primary Examiner*—Horace M. Culver

[57] ABSTRACT

A disposable container suitable for retaining liquids comprises two opposed container sections, each having a peripheral ring like flange about a recess with the flanges being sealed therebetween. The recesses of the opposed container sections define a common central cavity and the flanges includes a throat opening into said cavity through which product within the cavity can be dispensed. The throat is at least partially defined by the opposed container flanges and each container section is of a thermoformable plastic material. These container sections are originally formed from flat strip packaging material having diecut side edges with the strip defining individual container body sections. A tapered neck portion of each body section accomodates dispensing of the contents and preferably a hot melt adhesive secures the opposed container sections. The plastic containers are formed by intermittently advancing, in timed sequence, two strips through separate thermoforming operations where each strip is shaped to form a series of half containers and thereafter the strips are married and secured for subsequent operations. The invention also includes an apparatus and process for forming, filling and sealing the containers by advancing the packaging material through a number of stations along a predetermined path. The formed container is shaped to reduce inadvertent tipping thereof when supported in a free-standing disposition.

15 Claims, 8 Drawing Sheets

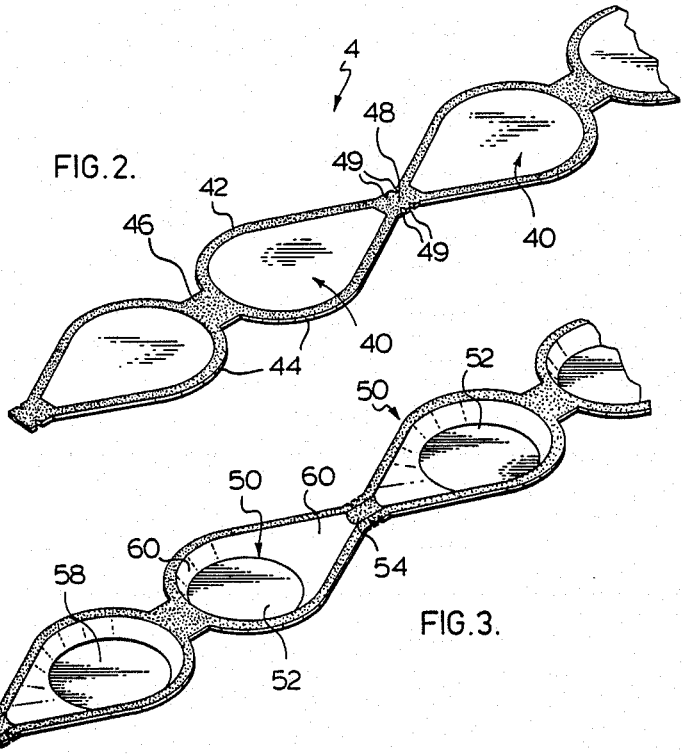
FIG. 2.
FIG. 3.
FIG. 4.
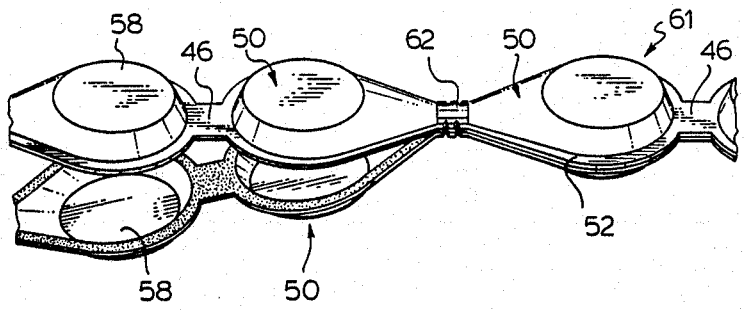

DISPOSABLE CONTAINER

BACKGROUND OF THE INVENTION

The present invention relates to apparatus for the packaging of liquid like products in individual containers. The invention particularly relates to an apparatus and method adapted to form, fill and seal a plastic container. This method and apparatus has particular application for the forming, filling and sealing of small containers such as creamers and/or condiments where the container is preferably sized for a single serving.

Apparatus for forming, filling and sealing of creamers are known and have a number of advantages over the pre-formed creamer containers which are subsequently used in a filling and sealing machine. The container forming operation suitable for the forming of plastic containers is normally accomplished by heating of a flat substrate in preparation for an extruding or shaping step. This heating operation acts to partially disinfect or sterlize what will become the interior of the container. Form fill seal machines are also advantageous in that the supply stock, namely flat plastic disks, sheeting, strip material of plastic or foil paper laminate and the like are easily stored. The main advantage with a form, fill, and seal machine is the reduced overall production cost for the operator as the container is formed in the filling apparatus and is made from relatively low cost material which may or may not be pre-cut by a diecutting operation. In most cases, the forming material is pre-printed and little additional labelling is required.

The packaging of creamers has been generally confined to small frusto conical containers which have a flat lid of a paper foil laminate heat sealed thereto. The volume of the container is quite small and the normal practice is to fill the container with $\frac{3}{8}$ to $\frac{5}{8}$ of an ounce of product. Numerous approaches have been taken with respect to filling of these containers, as generally the filling step determines the maximum output of the machine. In known filling machines, preformed open top containers are moved along a predetermined path past a filling operation and subsequently advanced through a heat sealing operation where a suitable lid is aligned with and heat sealed to the container. In some cases, the apparatus will have a conveyor driven intermittently, with various stations along the length of the conveyor which operate when the conveyor is stationary; or in other cases, the containers are continuously advanced and the various operations are carried out as the containers are advanced. In designing machines of either type described above, high output is difficult due to the time required for filling and sealing of the containers. The conventional containers are relatively shallow, and product splash can contaminate the generally flat flange area at the open top of the containers which is used for heat sealing the lid material to the container. Typically, the paper foil laminate has a thermally activated adhesive film on the lower surface to effect a seal between the lid and the container flange.

According to the present invention, a form, fill and seal apparatus and method are possible, suitable for the packaging of cream as well as other liquid like products including condiments. The apparatus and method allow the forming, filling and sealing of a container made from a previously diecut formable strip material such as plastic or foil. This method and apparatus in most cases reduces the unit cost to the operator, such as a dairy, for filling of a container as the need for previously formed containers is eliminated. A unique container is also disclosed which can be filled at a faster rate due to its generally closed configuration and is of a particular shape to render the container more stable in a free-standing disposition.

SUMMARY OF THE INVENTION

The disposable container of the present invention is shallow and includes support surfaces for supporting the container in a free-standing disposition with the container having a low profile due to the shallow depth of the container. The container is shaped to limit the extent of inadvertent tipping of the container and to provide an inherent bias urging the container to return to the free-standing dispostion. The throat of the container is positioned to take advantage of this inherent bias and reduce the likelihood of spilled product if the container is inadvertently tipped.

A disposable container according to an aspect of the present invention is suitable for retaining liquids and the like comprises two opposed container sections, each having a peripheral ring like flange about a recess with the flanges being sealed therebetween by an adhesive. The recesses in the container halves defines a common central cavity of the container and the flanges include a throat which opens into the cavity through which product within the cavity can be dispensed. The throat is at least partially defined by the opposed flanges. Each container section is of a similar thermoformable plastic material and the sections collectively define the cavity.

A strip of packaging material used in the forming of the container as generally described above has diecut side edges and includes container body sections each having a neck portion which serves to join container body sections. The strip is of a thermoformable sheet material which, on one side, includes a adhesive, preferably a thermally activated adhesive, appropriately placed for eventual sealing of opposed container sections.

The strip as described above is passed along predetermined path past a number of stations to produce a strip of thermoformed plastic container sections joined in series, with each container section having a flat generally planar peripheral flange area surrounding the upper edge of a generally upwardly opening central cavity. The flange is interrupted by a sunken neck portion which connects with the neck portion of an adjacent container. Each flange includes means on the upper surface thereof used to eventually join opposed container sections.

The method of the present invention forms a plastic container of fixed shape and comprises intermittently advancing, along predetermined paths, two strips of plastic thermoformable material through separate thermoforming operations. These thermoforming operations shape each strip to form a series of container sections with each half container section having a recess therein generally surrounded by a similarly sized flange and including a neck area, with the neck area accessing the recess. The flange includes a thermally activated adhesive thereon which will be used in joining of the container sections. During the thermoforming operation, the flanges are cooled to an extent sufficient to at least essentially maintain the adhesive below its activation temperature. Following the thermoforming operation, the strips are aligned in an opposed manner to create a series of containers, with each container being defined by a pair of container sections with said respective neck areas aligned to define a narrow throat for filling of the container. The aligned strips are then sealed about the containers by applying sufficient heat to said flanges to activate the hot melt adhesive while maintaining the narrow throat open and maintaining the plastic of the flanges below their own thermal activation temperature. All this preferably occurs as the strips are held stationary during a dwell time between advances of the strip. The containers are retained in a predetermined position within the conveyor and are subsequently cut from the strip in preparation for the filling operation. The containers are then appropriately filled through the throat of each container and after completion, the throat is sealed and the containers are released and removed from the conveyor for bulk packaging.

A packaging machine for the forming, filling and sealing of a container comprises two forming conveyors, each advancing thermoformable plastic strip material through separate forming operations; means for bringing the output of the forming operations into appropriate registration; container sealing means for sealing said container sections to provide a generally sealed container with a throat through which product can be introduced; a further conveyor for receiving the sealed strip of containers, said further conveyor engaging each container and advancing the same through cutting, filling and sealing stations associated with said further conveyor for first cutting said containers from said strips, orienting said containers, filling said containers and sealing said filled containers; and means associated with said further conveyor for discharging said sealed filled containers.

BRIEF DESCRIPTION OF THE DRAWINGS

Preferred embodiments of the invention are shown in the drawings, wherein:

FIG. 2 is a partial perspective view of the strip material;

FIG. 3 is a partial perspective view showing the strip material after it has been shaped;

FIG. 4 is a partial perspective view showing the registration of opposed container halves;

DETAILED DESCRIPTION OF THE PREFERRED EMBODIMENTS

Figure 1:
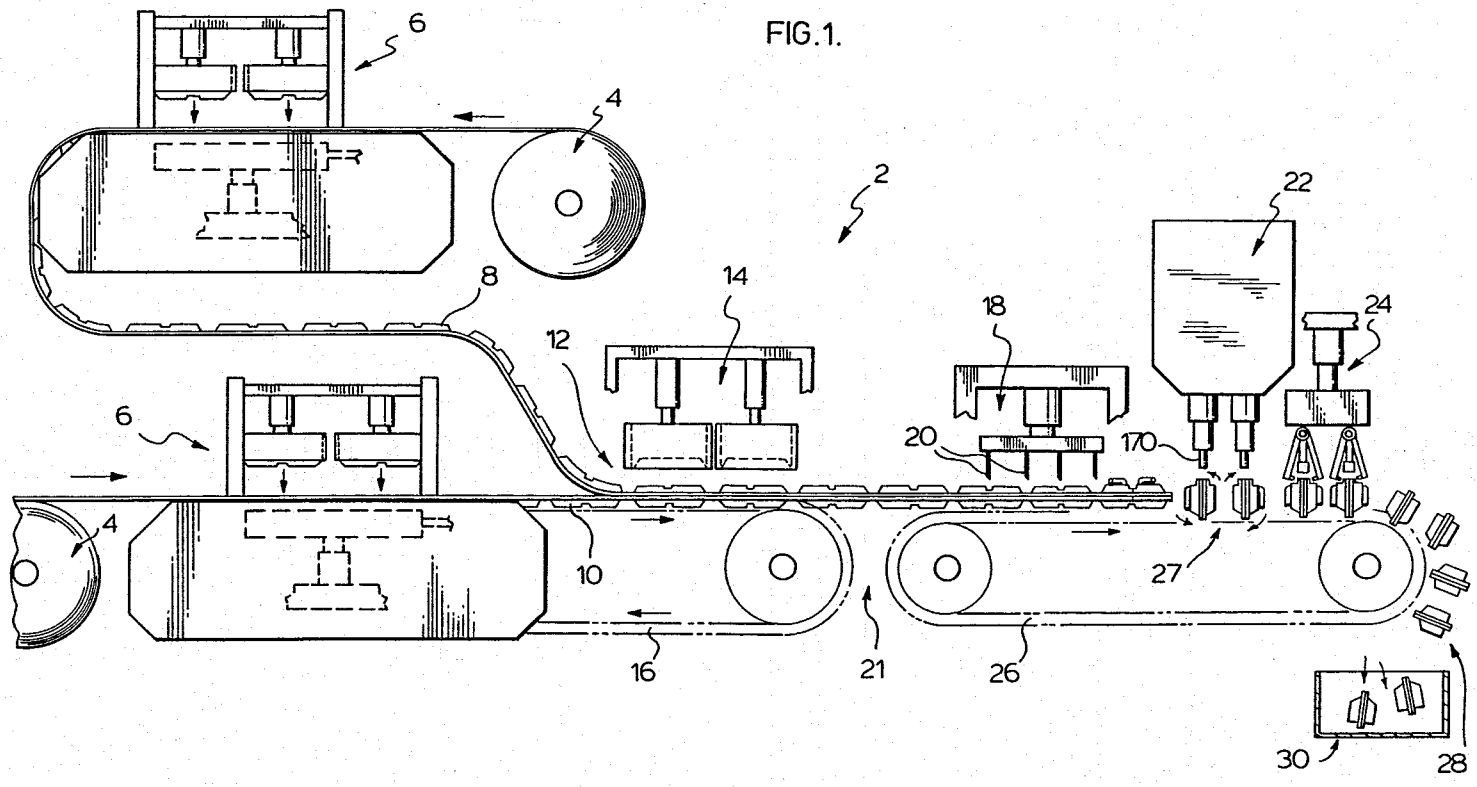
FIG. 1 is a partial side elevation showing the packaging machine.

The packaging machine 2 shapes previously diecut flat strip material generally shown as 4 by passing the same through forming stations 6. The forming stations heat the strip material after it has been registered in a conveyor and therefore physically urge the material into the conveyor plate and create the first formed container strip 8 and the second formed container strip 10. These formed container strips, after passing through their separate forming stations 6, are brought into opposed alignment as generally indicated at point 12 immediately upstream of the flange sealing station 14 and are so maintained by the conveyor plate. Each of the forming stations 6 have their own conveyor 16 comprising linked plates having recesses therein for receiving in a registered manner the flat strip material 4. The recesses also define the final shape of the container sections and are used in the forming thereof. The aligned strips, at point 12, are both engaged by the conveyor 16 of the second forming station and are advanced together by the conveyor. Both conveyors are of the intermittent movement type and the various operations, particularly the forming, are carried out while the conveyor is stationary.

Figure 9:
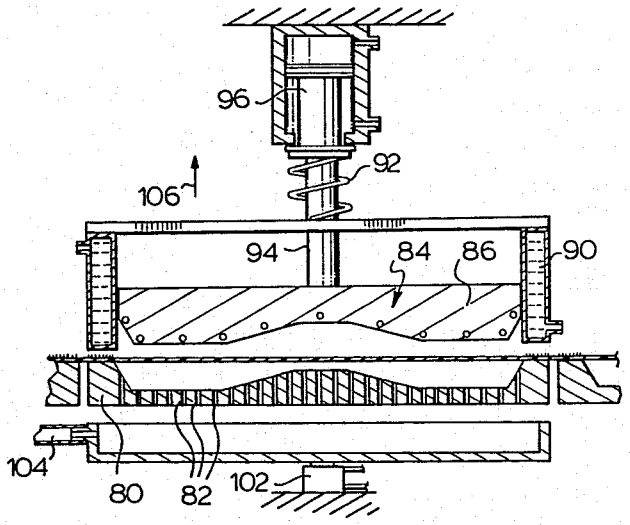
FIG. 9 is a view similar to FIG. 8 with the forming station in a position clear of the strip.
Figure 8:
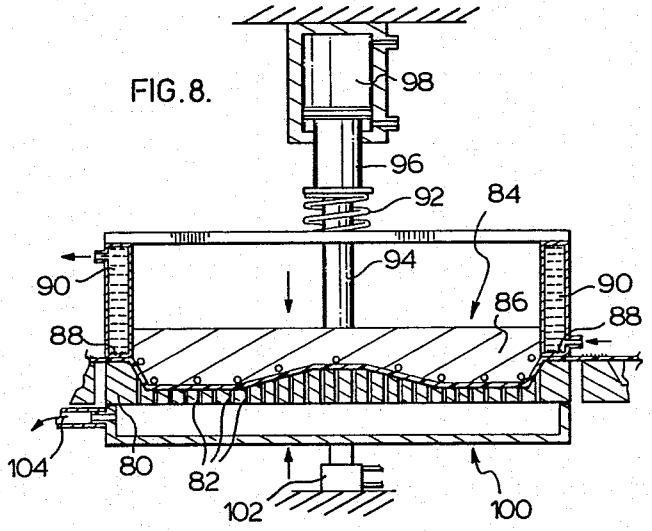
FIG. 8 is a cross-section through a conveyor plate and the forming station.

The conveyor plates are shown in section in figures 8 and 9 and the strip is advanced with the conveyor as the formed container sections are nested therein. The cavity of the plates are similar to those of the final conveyor, shown in FIG. 12 and, additionally, may be recessed to engage connecting portions 52 of the strip material to assist in registration. Flange sealing station 14 operates on four containers disposed in series and seals the container sections generally about the periphery by thermally activating an adhesive between opposed flanges. The preferred hot melt adhesive is activated by applying heat to the upper flange as the containers are held stationary at the sealing station. Care must be exercised as the activation temperature of the hot melt adhesive is normally only about 30° .F to 50° F. below the softening point of the thermoformable material. Too much heat will cause adhesion of the flange to the heating members and the flange would not fulfill its intended function essentially as an inert separator between the heating member and the hot melt adhesive. Styrene, a suitable packaging material generally softens or starts to become active at about 300° F. and therefore the rate of heat transfer to the flanges is important to avoid the flanges reaching a temperature resulting in adhesion of the flanges to the heads. These heads are preferably coated with a teflon or like material to reduce adhesion problems.

The partially sealed containers are then advanced across a transition zone generally designated as 21 downstream of the flange sealing station 14 and upstream of the final conveyor 26.

The final conveyor 26 has rotatable plates to cause the containers to rotate for the filling and final sealing operations. The first station associated with the final conveyor is the slitting station 18 which includes reciprocating slitters 20. During the conveyor dwell time, the slitters cut the containers from the strip material and thus allow the containers during the next advancement of the conveyor to rotate as generally shown at position 27. Once the containers are rotated, product is filled through a throat-like opening while the containers are stationary at the filling station 22. After the filling station, the throat sealing station 24 closes the container, whereafter the containers are finally discharged for bulk packaging at 28. The discharged containers from the final conveyor 26 are suitably collected at collection point 30. An automatic bulk packaging arrangement can be used in conjunction with and controlled by the packaging machine 2.

FIGS. 2 through 7 illustrate the various steps completed to transform the container strip material 4 into the separate containers shown as 68. The flat strip material 4 is made up of a number of container blanks 40, having a suitable non-toxic, food safe adhesive at least about the periphery of the container blank. This adhesive is preferably previously printed or otherwise applied, on the strip of packaging material and thus the strip material 4 used by the filling machine has been previously coated with the adhesive. It should also be noted that the adhesive need not be restricted to peripheral areas and in some cases can entirely cover one surface of the container blank. Note that the strip material 4 comprises a series of paired container blanks symmetrically disposed with the pair of container blanks being interconnected to adjacent pairs by connecting portions 46. Neck connecting portion 48 serves to join container blanks of a pair. Notches 49 are associated with the neck portion and have been previously formed by die cutting and are used to assist in opening the filled and sealed container. The notches 49 in the finished container are preferably about ⅜ of an inch from the sealing end of the throat (sealed bead 72 in FIG. 7). The outer periphery of the flat strip material 4 is also die cut and is used to cooperate with the conveyor plates to assure proper registration of the container blanks in the conveyor plates, particularly of the forming conveyors. The die cut periphery is generally shown as 44.

In FIG. 3 the container blanks 40 have undergone the forming operation resulting in individual container sections 50 each having a perhipheral flange 52 extending laterally therefrom with the adhesive 42 on this peripheral flange. Container section 50 has an open container section cavity 54 and a container section inlet 56 opening into the container section cavity 54. A flat panel 58 defines the lower portion of the container section cavity and will provide a support surface or area for the finished container 68. Sidewall 60 extends upwardly from the panel 58 of a container section 50 and joins the panel with the peripheral flange 52. The inlet 56 is generally positioned at the upper edge of the container section sidewall 60.

The formed strip of container sections are brought into registration with an opposed formed strip of container sections as illustrated in FIG. 4. Each container section is in an opposed facing relationship with a like container section to cooperate therewith and eventually define the strip of joined containers 61. The opposed connecting portions 46 of the strip material are secured and each container section is secured to an opposed container section by means of the adhesive 42 on the peripheral flanges 52. The opposed container section inlet 56 now define a throat 62 which is in communication with the cavity of the open container generally shown as 59 in FIG. 5. The throat 62 is in a sidewall of the container 59 intermediate and spaced from panels 58.

Figure 6:
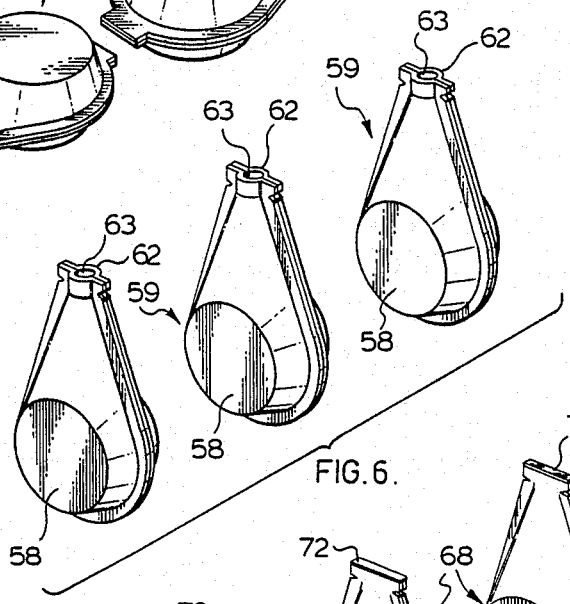
FIG. 6 shows the containers positioned for filling.

The open containers 59 have been cut one from the other by the cutting station and are shown oriented for filling in FIG. 6. The throat 62 is oriented to allow filling of the open containers 59 through the throat mouth 63 which is in direct fluid flow communication with the container cavity. The containers are maintained in their vertical orientation after filling to effect sealing of the containers to produce the sealed containers 68 shown in FIG. 7. These sealed containers each have a melted bead 72 which extends across the throat and serves to assist the adhesive in maintaining the throat closed. Note that the throat has been partially collapsed by the sealing operation and the seal of the throat area is somewhat more difficult. By melting the edges of the opposed container sections in this area, the possibility of release of the adhesive and leakage of the product is reduced.

Figure 7:
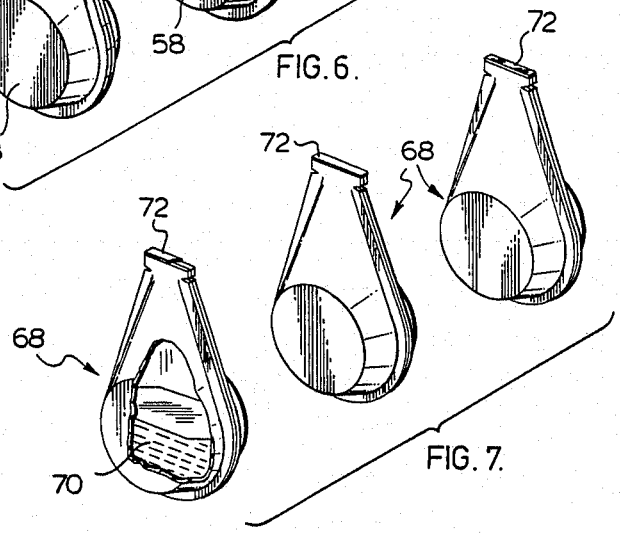
FIG. 7 shows the containers after they have been subjected to a heat sealing operation after the filling step.

As shown in the cut-away portion of one of the filled and sealed containers 68, a liquid portion 70 is retained within the container cavity and when the container is in position as shown in FIG. 7, this product tends to accumulate in the lower portion of the container. Thus when the container is open the likelihood of spillage of the product is reduced. The flat strip material 4 can be pre-printed such that the flat panels 58 act as labelling surfaces and include a pre-printed label thereon. The thermoforming operation will not significantly affect the print on this location as it is merely being displaced within the cavity and most extrusion of the strip material occurs in the sidewall 60.

Figure 5:
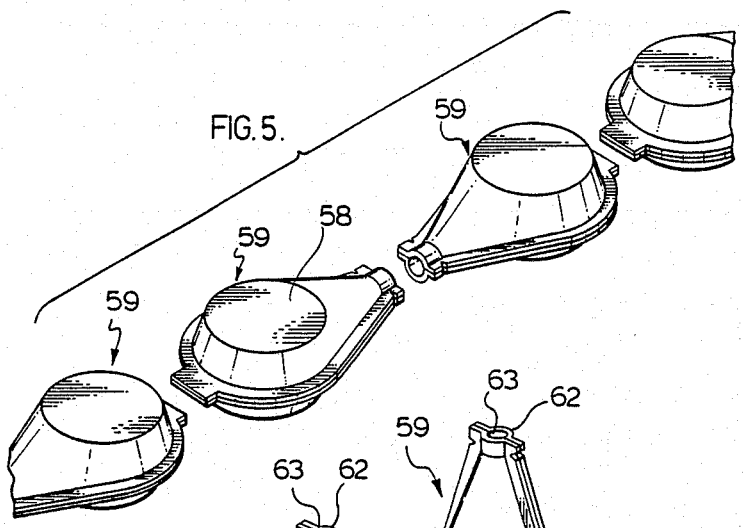
FIG. 5 is a partial perspective view showing the strip material after the first sealing operation and after the cutting operation.

These panel portions 58 act as support surfaces for the container whether open or closed and when supported on one of these surfaces the throat extends laterally from the container cavity and is at a raised position relative to the support surface. In this position any residual product in an open container is maintained within the container cavity to the extent that the product is below the level of the throat mouth 63. Thus panels surfaces 58 are used to support the container in one of two free-standing dispositions. In this free- standing disposition as generally shown in FIG. 5, the container due to its inherent shape and shallow depth is not prone to tipping and even if inadvertently tipped, gravity serves to create a bias which will force the container back to the free-standing disposition. The perhipheral flanges 52 also cooperate with the panels 58 to act as a stop surface limiting the extent of the inadvertent tipping of the container due to the flange coming into contact with the support surface. Thus the container has an inherent bias urging it to one of two free-standing dispositions and in either disposition the throat is a raised point relative to the support surface. The peripheral flange as it extends about the container limits the angle through which the container can be tipped and gravity acting on the container forces the container to return to the free-standing disposition. The shallow profile of the container is also less prone to being accidentally tipped by the user.

The formed containers are elongated and of shallow depth with the depth of the cavity being less than one-third of the maximum width. The cavity volume in the case of creamers is preferable about ⅝ ounces and the filled quantity of creamers is normally about ½ ounce or less. The panels 58, which each act as a support surface and a labelling surface, could be modified and the entire panel 58 need not be part of the support surface. For example, support feet could be formed in the container about the periphery of the panel 58 which collectively define a support surface similar to 58 in that the container would continue to have the inherent bias to assume the free-standing disposition on a planar surface.

The container is less prone to tipping, and even if inadvertently tipped returns to the free-standing disposition. The container if tipped may not result in the spilling of product, as the throat may not be displaced to a position which would result in the product leaving the container. The container is also more convenient to fill due to its generally closed container cavity with product being introduced through a filling tube inserted in the formed throat 62.

A further advantage of the container is the labelling area defined by the panels 58 and the manner in which one of these panels is always presented at the top of the container when the container is in its free-standing disposition. Such is not the case with the prior art creamer cups where labelling is restricted to the lid area.

FIG. 8 shows the forming station which includes conveyor plates 80 having vacuum ports 82 for drawing the plastic in contact therewith. Forming pad 84 is shaped according to the final shape of the container and includes a heated face 86. In order to protect the preferred thermally activated adhesive, the forming pad 84 also includes a flange protecting portion 88, which has a fluid cooling jacket 90. Thus, when the heating pad is brought into contact with the plastic sheet material, the flange area is cooled by the cooling jacket or at least maintained at a temperature below the activation of the adhesive. The forming pad 84 is mounted on shaft 94 which is slidably received in cylinder portion 96. A spring bias 92 is provided between the pad 84 and cylinder portion 96 to assist the forming of the container sections. The pad, when it first comes into contact with the sheet material, does not bottom out within the cavity of the conveyor plate due to compression of the spring bias 92 and the pad will initially heat the sheet material and as the sheet material softens, the pad will move within the cavity in accordance with the spring bias and the strength of the softened sheet. From the above it can be appreciated it is preferable to restrict the adhesive to the flange area, thus simplifying in the forming operation and reducing contamination of the heating face 86.

The movement of the sheet material within the conveyor plate 80 is assisted by the vacuum box 100 which has been brought into engagement with the lower surface of the conveyor plate. A vacuum force effectively draws the sheet material against the interior surface of the conveyor plate. Each plate 80 includes in the lower surface thereof vacuum ports 82. The vacuum box 100 is pneumatically actuated by actuator 102 and moves in timed sequence with the conveyor into and out of contact with the plates and similarly the forming pad 54 is reciprocated via the pneumatic actuator generally indicated as 98. The extreme positions of the reciprocating movement of the forming pad 84 are shown in FIG. 8 and FIG. 9 where the pad has been fully withdrawn in FIG. 9 and the pad fully inserted in FIG. 8. In FIG. 9, the conveyor has been advanced to bring a new portion of sheet material within the forming station. The vertical reciprocating motion of the pad is indicated by arrow 106. Note that the forming station shown in FIG. 1 includes two pairs of forming pads and only one set of these pads has been shown in FIG. 8. In effect, the forming station forms four container sections for each cycle of the conveyor and FIG. 8 only shows two heads. The forming operation is the most time consuming operation and therefore pairing of the forming pads allows the overall packaging machine to operate at a higher output. Typically, the cycle of the machine when four containers are formed per line is about 2.4 seconds, of which the stationary time is 1.8 seconds. Thus, each index of the conveyor results in the advancement of four containers.

Figure 10:
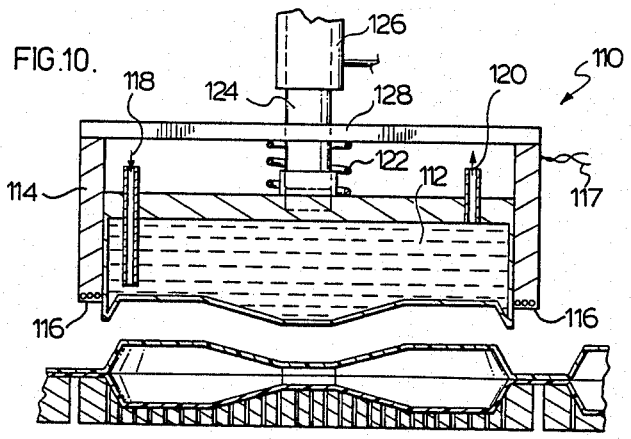
FIG. 10 is a sectional view through the first heat sealing station.
Figure 11:
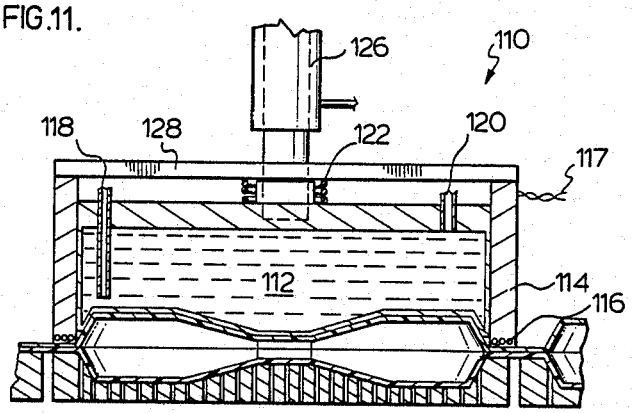
FIG. 11 is a view similar to FIG. 10 with the pad of the heat sealing station in contact with the strip material.

Details of one of the sealing heads 110 of the sealing station 14 is shown in FIGS. 10 and 11. Interior to the sealing head 110 is a water cooled central member 112 which slides within the outer housing 114 of the head. The water cooled central member 112 is hollow and water is circulated through the cavity via water inlet 118 and water outlet 120. The central member 112 is shaped to lie in intimate contact with the upper surface of the container to essentially limit the heat of sealing to the overlapping flange area or at least protect the rest of the container from damaging heat. The outer housing 114 includes heated surfaces 116 which contact the upper flange and heat the same. This heat is conducted through the flange to activate the adhesive between the opposed flanges of the container sections and effect sealing of the container sections. Pressure is exerted between the sealing head and the conveyor plate and the central member is spring-biased as indicated by spring 122 such that the central member initially contacts the container and further movement of the sealing head will bring the heated surfaces 116 into contact with the container flanges. This spring biasing arrangement will also ensure that the heated surfaces 116 are first to release contact from the containers.

The water cooled central member 112 is secured at one end of the piston-like rod 124 and the outer housing 114 is movable on the rod 124. The piston-like rod 124 telescopes within the sleeve 126 and the sealing head 110 is reciprocated to effect initiation and removal of the sealing head from the container. As the central member bottoms out against the container, the spring 122 is compressed as indicated in FIG. 11 and the outer housing is driven into contact with the flanges due to contact of the sleeve 126 with the upper surface of the housing generally indicated as 128. Therefore, as the sealing head is brought into contact with the container, the central member initially bottoms out against an upper container section and subsequent movement of the sealing head will cause compression of the spring and eventual contact of the heated surfaces 116 with the flanges of the container. As sleeve 126 is initially removed from the container sections, the heated surfaces 116 will move therewith due to the action of the spring 122 while the central member remains in contact to further ensure that integrity of container sections is maintained. Thus, this sealing head serves to isolate the heat of the sealing head to the periphery of the container sections, and the water cooled central member protects areas of the container which are not to be raised to this higher temperature. This heat removal also serves to set the adhesive more quickly.

The sealing head of FIG. 10 and 11 is only one such head for sealing of the flanges of two containers, however the sealing station 14 would include a second set of heads to complete sealing of four containers disposed in series along the length of the conveyor. Thus, each of the container sections is paired within a conveyor plate and each operation is effected on a pair of conveyor plates. Therefore, each operation is being carried out on a series of containers four in length and any number of series of containers sections can be disposed across the machine. Power is introduced to the heated surfaces 116 through the electrical connections 117.

Figure 12:
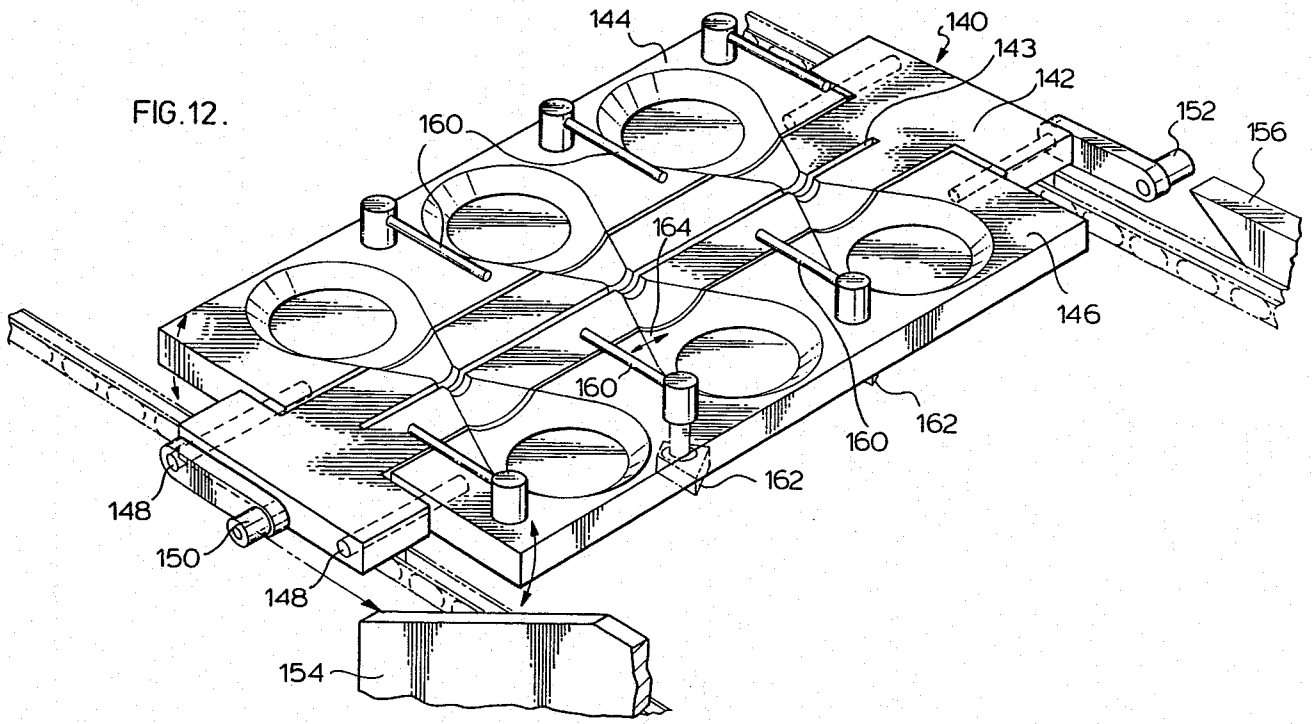
FIG. 12 is a partial perspective view showing the conveyor plates used in the forming of the strip material.

The conveyor plates of the final conveyor are shown as 140 in FIG. 12 and include a central member 142 secured to the chain drive and are of a generally 'I' shaped. Extending in the longitudinal axis of the member 142 is the slitter guide 143 to effect separation of the symmetrically opposed throat sections of a pair of containers. Secured to the central member 142, to one side, is the trailing pivotal plate 144 and, to the opposite side, a leading pivotal plate 146 is secured. These plates pivot relative to the central member. Pins 148 are secured to the respective plates 144 and 146 and are rotatably received by central member 142.

Cam actuator 152 is secured to one pins of the leading plate and a cam actuator 150 is secured to one of pins of the trailing conveyor plate. Cam actuator 152 cooperates with the stationary cam shown as 156 and cam actuator 150 cooperates with stationary cam 154. The cam actuators 150 and 152 control the position of the movable plates 144 and 146 and will cause the containers to move to the generally vertical orientation shown in FIGS. 13 and 14 for carrying out the filling operation. Two different cams are used, 154 and 156, due to the opposite rotation that each plate must undergo. Note that the conveyor plates 144 and 146 rotate intermediate the space between the chain drive.

Prior to rotating of the plates to a generally vertical orientation, container retaining arms 160 move across the upper surface of the container to retain the container within the cavity of the pivotal plate. These container retaining arms are pivotally secured within the respective pivotal plates and pass through the plate where an actuator 162 is located on the lower surface of the plate for controlling the position of the arms.

Figure 13:
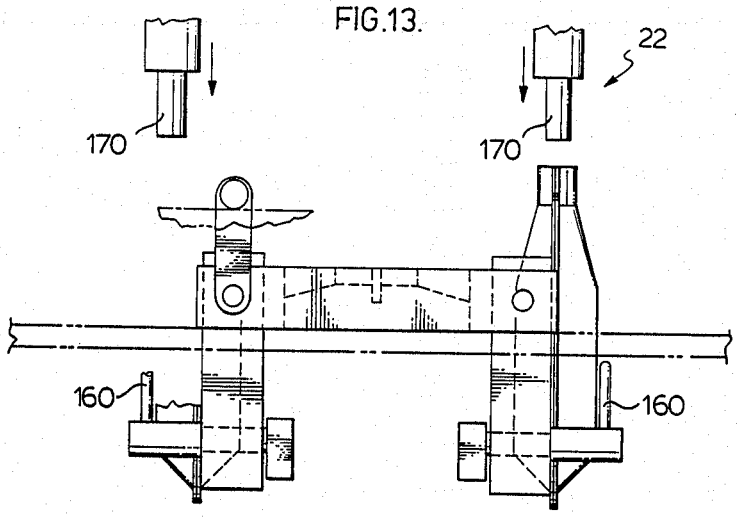
FIG. 13 is a sectional view showing movement of the final conveyor plates to a filling orientation.
Figure 14:
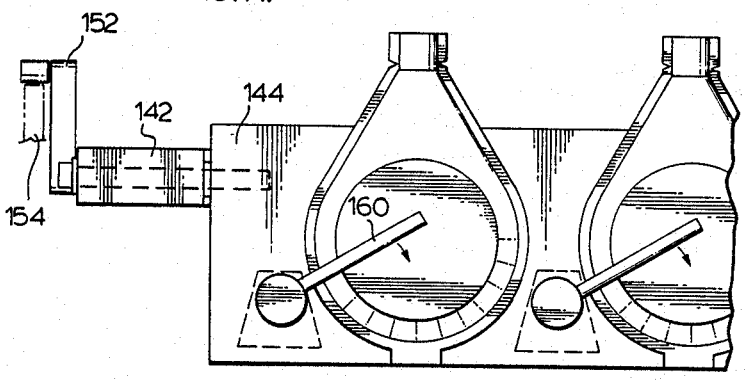
FIG. 14 is a top view showing a mechanism for retaining the containers in the final conveyor.

The pivotal plates 144 and 146 have been rotated in FIG. 13 and the containers received in the plates are aligned beneath a filling tube 170 of the filling station 22 when the conveyor is brought to rest. Thus, the throat of the containers are aligned and in registry with the filling tubes 170 whereafter the filling head may be lowered such that the filling tube is inserted through the throat to commence filling of the containers.

The movement of the pivotal plates 144 and 146 and the mechanism for actuating the retaining arms 160 have been described with respect to various cam mechanisms and it can be appreciated that other arrangements are also possible. In particular, the retaining arms could be biased to one position and only require forced movement in one direction, or the arms could be free moving and as such, full control over the actuators 162 would be necessary. Therefore, the embodiments as shown in FIGS. 12 and 13 can be modified and, in particular, the actuators 150 and 152 may be controlled along the entire conveyor length as opposed to merely contacting various cam members as indicated in Figure 12.

In order to maintain registration, all conveyors are advanced in timed sequence.

Figure 15:
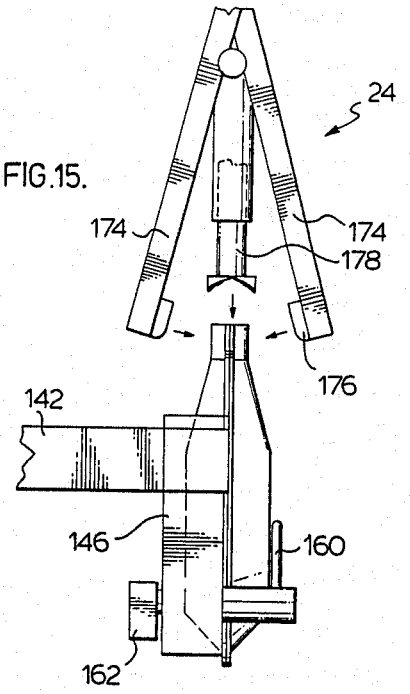
FIG. 15 is an elevation showing the sealing of the filled containers.

Sealing of the filled containers occurs at the station 24 and one such sealing operation is generally shown in FIG. 15. A pair of pinch arms 174 move down over a portion of the throat of the container and are actuated, deforming the throat to flatten a portion thereof. Heat is then applied to both sides of the flattened portion to activate the hot melt adhesive located on this portion of the container and to soften the previously shaped plastic to reduce the required adhesive force. Each pinch arm includes a heated pad generally indicated as 176. After the throat has been deformed, a melting bar 178 is preferably brought into engagement with the top of the throat of the container which has been deformed and the purpose of the bar is to melt the plastic and provide a generally round bead 72 at the end of the throat to ensure a complete seal thereof. Sealing of this throat region is somewhat more difficult in that it has been deformed to define the throat and the strength inherent in this deformation must be overcome. This area is more difficult to seal and a melted bead at the top will ensure that the throat is fully sealed. Melting of the plastic has been described as one approach to avoid the possibility of "leakers", however it may not be required in all cases. In some cases, it may be preferable to heat the plastic material in the throat to flatten and reshape the same, whereby sealing is easier. Therefore, other arrangements are possible including merely relying on the strength of the adhesive.

Figure 16:
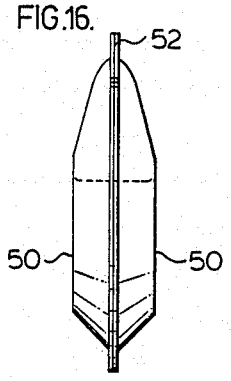
FIG. 16 is an end view of a filled container.
Figure 17:
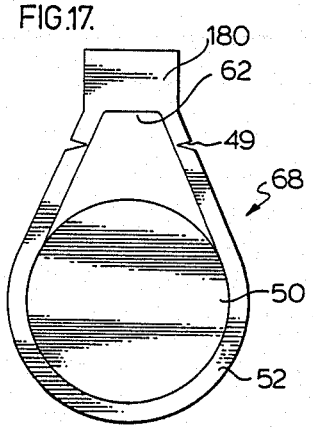
FIG. 17 is a front view of the filled container.

The sealed product is generally shown in FIG. 17 and the product level within the container is generally indicated in the end view of FIG. 16. This teardropped shaped product can be bulk packed in a random orientation and is not prone to leakage. The container, when used, is orientated in generally an upright condition and the throat of the container is opened assisted by notches 49. As can be appreciated, the product is essentially retained within the lower central cavity and the person opening the container is deforming the container in the throat region and product is retained in the container cavity. Therefore, the likelihood of spilling any of the contents of the container is greatly reduced. Tearing of the throat region will result in some pinching of the throat, thus further reducing the likelihood of any contents of the container being inadvertently discharged.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A disposable container of fixed shape comprising:

first and second container sections in opposed facing relationship defining a cavity for retaining a small portion of a pourable product and an elongate throat opening into said cavity and extending outwardly away from said cavity, said throat tapering inwardly from said cavity to a free end of said throat which is flat and sealed, said throat increasing smoothly and symmetrically in size from said free end to the width and depth of said cavity with no clear line of demarcation between said throat and said cavity, said throat adjacent said free end including a notched region for removing said sealed free end to effect opening of said throat, said throat being of a length sufficient to effect pinching and deformation of said throat by finger pressure exerted on said throat by a user intermediate said notched region and said cavity during removal of said flat sealed free end, said container sections defining at least one support surface for free standing disposition of said container with said throat at a raised position and wherein each container section includes only one support surface for disposition of said container in one of only two free standing dispositions.

2. A disposable container as claimed in claim 1, wherein said container is shaped to return to said free standing disposition if tipped therefrom.

3. A disposable container as claimed in claim 1, wherein said container sections include overlapping flanges extending outwardly of said cavity which limit the angle through which the container moves if inadvertently tipped.

4. A disposable container as claimed in claim 1 including a peripheral ring-like member about said container and spaced from said support surface to act as a stop surface limiting the extent of inadvertent tipping of said container from the free-standing disposition.

5. A disposable container as claimed in claim 4, wherein each container section includes a peripheral flange with said flanges being in opposed relation and secured to provide a sealed cavity between said sections, at least one of said flanges acting as said peripheral ring-like member.

6. A disposable container as claimed in claim 1, wherein said container sections are generally symmetrical and said container has only two support surfaces for free standing disposition of said container and each container section defines one of the said two support surfaces, said container sections being shaped to cooperate with both said support areas to bias said container to said free-standing disposition when inadvertently tipped therefrom.

7. A disposable container as claimed in claim 6, wherein said container will assume said free standing disposition when supported by a flat surface.

8. A container according to claim 1, wherein said cavity is shallow when said container is in said free-standing dispostion, said cavity having a depth between said opposed first and second sections less than a third of the maximum lateral width of said cavity and a gravity bias is created urging said container to said free-standing disposition.

9. A disposable container as claimed in claim 1, wherein said throat at the junction of said cavity and said throat are of a depth approximating the maximum depth of said cavity.

10. A disposable container as claimed in claim 1, wherein said throat defines a funnel-like passage through which contents of the container are dispensed.

11. In a disposable container of fixed shape for packaging of a pourable single foodstuff serving comprising:

first and second container sections in opposed facing relationship defining a cavity which retains such pourable foodstuff serving, the improvement comprising an elongate throat opening into said cavity and extending outwardly away from said cavity said throat tapering inwardly from said cavity to a free end of said throat which is flat and sealed, said throat increasing smoothly and symmetrically in size from said free end to the width and depth of said cavity with no clear line of demarcation between said throat and said cavity, said throat adjacent said free end including a notched region for removing said sealed free end to effect opening of said throat, said throat being of a length sufficient to pinch and deform said throat by finger pressure exerted on said throat by a user intermediate said notched region and said cavity during removal of said flat sealed free end.

12. In a disposable container as claimed in claim 11, wherein said container sections defining at least one support surface for free standing disposition of said container with said throat at a raised position and wherein each container section includes only one support surface for disposition of said container in one of only two free standing dispositions.

13. In a disposable container as claimed in claim 11, wherein said throat and said cavity cooperate to define a container of a teardrop-like section.

14. In a disposable container as claimed in claim 11, wherein said throat at the junction of said cavity and said throat are of a depth approximating the maximum depth of said cavity.

15. In a disposable container as claimed in claim 11, wherein said throat defines a funnel-like passage through which contents of the container are dispensed.

* * * * *